US008166612B2

(12) United States Patent
Bertolini et al.

(10) Patent No.: US 8,166,612 B2
(45) Date of Patent: May 1, 2012

(54) ADJUSTABLE HINGE FOR PIVOTING DOOR

(75) Inventors: Nilton Carlos Bertolini, Anderson, SC (US); Cory Dale Simpson, Abbeville, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 262 days.

(21) Appl. No.: 12/713,823

(22) Filed: Feb. 26, 2010

(65) Prior Publication Data

US 2010/0218342 A1 Sep. 2, 2010

Related U.S. Application Data

(60) Provisional application No. 61/155,924, filed on Feb. 27, 2009.

(51) Int. Cl.
*E05D 7/04* (2006.01)

(52) U.S. Cl. ..... 16/244; 16/241; 16/375; 16/309; 16/312

(58) Field of Classification Search ..... 16/244, 16/243, 248, 309, 312, 374, 375, 303, 330, 16/338, 340; 312/326, 309, 405, 295, 227; 49/381, 388, 397
See application file for complete search history.

(56) References Cited

U.S. PATENT DOCUMENTS 1,772,194 A 8/1930 Schoemer
2,302,484 A 11/1942 Werner
3,065,498 A * 11/1962 Johnson ..... 16/359
3,592,257 A 7/1971 Matyas
3,662,493 A 5/1972 Foltz
3,683,453 A * 8/1972 McLeland et al. ..... 16/248
3,722,031 A * 3/1973 Bourgeois ..... 16/317
4,070,728 A 1/1978 Herman
4,090,274 A * 5/1978 Bourgeois ..... 16/317
4,215,448 A * 8/1980 Burns et al. ..... 15/210.1
4,474,740 A * 10/1984 Karwat et al. ..... 423/242.7
4,609,234 A * 9/1986 Naniwa et al. ..... 312/296
4,864,691 A * 9/1989 Gidseg et al. ..... 16/312
5,054,163 A 10/1991 Sterling et al.
5,265,954 A * 11/1993 Keil ..... 312/405
5,369,842 A * 12/1994 Beatty ..... 16/317
5,495,639 A * 3/1996 Wartian ..... 16/79
5,788,351 A 8/1998 Prunty et al.
6,030,064 A 2/2000 Kim
7,490,384 B2 * 2/2009 Lee ..... 16/244
7,607,200 B2 * 10/2009 Chang ..... 16/303
(Continued)

FOREIGN PATENT DOCUMENTS

FR 2175323 10/1973
(Continued)

OTHER PUBLICATIONS

Partial International Search Report for PCT/US2010/025572, dated Nov. 4, 2010, 2 pages.

*Primary Examiner* — Chuck Y. Mah
(74) *Attorney, Agent, or Firm* — Pearne & Gordon LLP

(57) ABSTRACT

A hinge assembly is provided for a pivoting door mounted about an opening, and may include a hinge plate, an internally threaded adjuster, a locking element, a first cam element, a second cam element, and a limiting plate. The hinge plate is mounted about the opening and includes a pivot projecting therefrom.

18 Claims, 3 Drawing Sheets

U.S. PATENT DOCUMENTS

| | | | | |
|---|---|---|---|---|
| 7,752,709 | B2 * | 7/2010 | Moon et al. | 16/244 |
| 8,006,346 | B2 * | 8/2011 | Zhang et al. | 16/303 |
| 2005/0188506 | A1 * | 9/2005 | Lee et al. | 16/376 |
| 2005/0262663 | A1 | 12/2005 | Lee | |
| 2006/0143860 | A1 | 7/2006 | Park et al. | |
| 2006/0168760 | A1 * | 8/2006 | Espindola et al. | 16/374 |
| 2006/0244351 | A1 | 11/2006 | Moon et al. | |
| 2009/0038117 | A1 * | 2/2009 | Moon | 16/240 |

FOREIGN PATENT DOCUMENTS

| | | |
|---|---|---|
| KR | 20010057905 | 8/2002 |
| WO | 2007094523 | 8/2007 |

* cited by examiner

ADJUSTABLE HINGE FOR PIVOTING DOOR

CROSS-REFERENCE TO RELATED APPLICATIONS

This application claims the benefit of U.S. Provisional Application No. 61/155,924, filed Feb. 27, 2009, the entire disclosure of which is hereby incorporated herein by reference.

FIELD OF THE INVENTION

The present invention relates generally to hinge assemblies, and more particularly, to hinge assemblies for adjusting the height of a pivoting door on enclosed structures.

BACKGROUND OF THE INVENTION

A cabinet, such as a refrigerator, often includes multiple doors that provide access to a variety of compartments. One issue not easily resolved during the manufacturing process for the cabinet is that a door will not be at the exact predetermined height and side-by-side doors may be differ in height such that the misalignment gives in an unattractive appearance to consumers. Sometimes such a defect is not noticed until the product has left the manufacturing site and a service technician has to be dispatched to fix the problem. Moreover, the alignment of the doors involves a process of trial-and-error and can be time-consuming. For example, one known method involves adding shims, which are usually not available to the consumers, to one or more door hinges to adjust the height of the doors. This method is disadvantageous in that tools and shims must be available to make the adjustment and the door must be removed from the cabinet in order to add the shims.

BRIEF SUMMARY OF THE INVENTION

In one example embodiment, a hinge assembly is provided for a pivoting door mounted about an opening, and includes a hinge plate, an internally threaded adjuster, and a locking element. The hinge plate is mounted about the opening and includes a pivot projecting therefrom and a hole extending therethrough. The pivot includes a threaded section and defines an axis about which the door can pivot. The internally threaded adjuster arranged is about the threaded section of the pivot and is configured to be rotatably adjustable along the threaded section. The adjuster includes a plurality of teeth that are peripherally arranged thereabout to define a plurality of recesses that are capable of becoming aligned with the hole through movement of the adjuster. The adjuster is further configured to support the door. The locking element is configured to extend through the hole and at least partially into one of the plurality of recesses to thereby maintain a position of the adjuster along the pivot.

In another example embodiment, a hinge assembly is provided for a pivoting door mounted about an opening, and includes a hinge plate, a first cam element, and a second cam element. The hinge plate is mounted about the opening and includes a pivot projecting therefrom. The first cam element is placed about the pivot and includes a first inner cam at a first radius and a first outer cam at a second radius. The first inner cam has a first elevation range and the first outer cam has a second elevation range. The first inner cam and the first outer cam are offset in elevation about one another such that the first elevation range and the second elevation range do not overlap. The first cam element further includes a first lobe at the first radius and a second lobe at the second radius. The first lobe and the second lobe are angularly offset about one another. The first cam element defines an axis on which a door can pivot. The second cam element is configured to be mounted about the door and to interact with the first cam element. The second cam element has a second inner cam at the first radius and a second outer cam at the second radius. The second inner cam has a third elevation range and the second outer cam has a fourth elevation range. The second inner cam and the second outer cam are offset in elevation about one another such that the third elevation range and the fourth elevation range do not overlap. The second cam element further includes a first downward lobe of the second inner cam and a second downward lobe of the second outer cam. The first downward lobe and the second downward lobe are angularly offset about one another.

In yet another example embodiment, a hinge assembly is provided for a pivoting door mounted about an opening. The hinge assembly includes a hinge plate, a first cam element, a second cam element, and a limiting plate. The hinge plate is mounted about the opening and includes a pivot and a stopper both projecting from the hinge plate. The pivot defines an axis about which the door can pivot. The first cam element is arranged about the pivot. The second cam element is configured to be mounted about the door and to interact with the first cam element. The limiting plate is mounted about the second cam element and includes a limiter positioned to catch the stopper during a rotation of the door such that a rotational range of the door is limited to a predetermined angle. The limiting plate is capable of being angularly adjusted about the second cam element such that the rotational range of the door is adjusted to a different predetermined angle.

BRIEF DESCRIPTION OF THE DRAWINGS

These and other aspects are better understood when the following detailed description is read with reference to the accompanying drawings, in which.

DESCRIPTION OF EXAMPLES OF EMBODIMENTS

Figure 1:
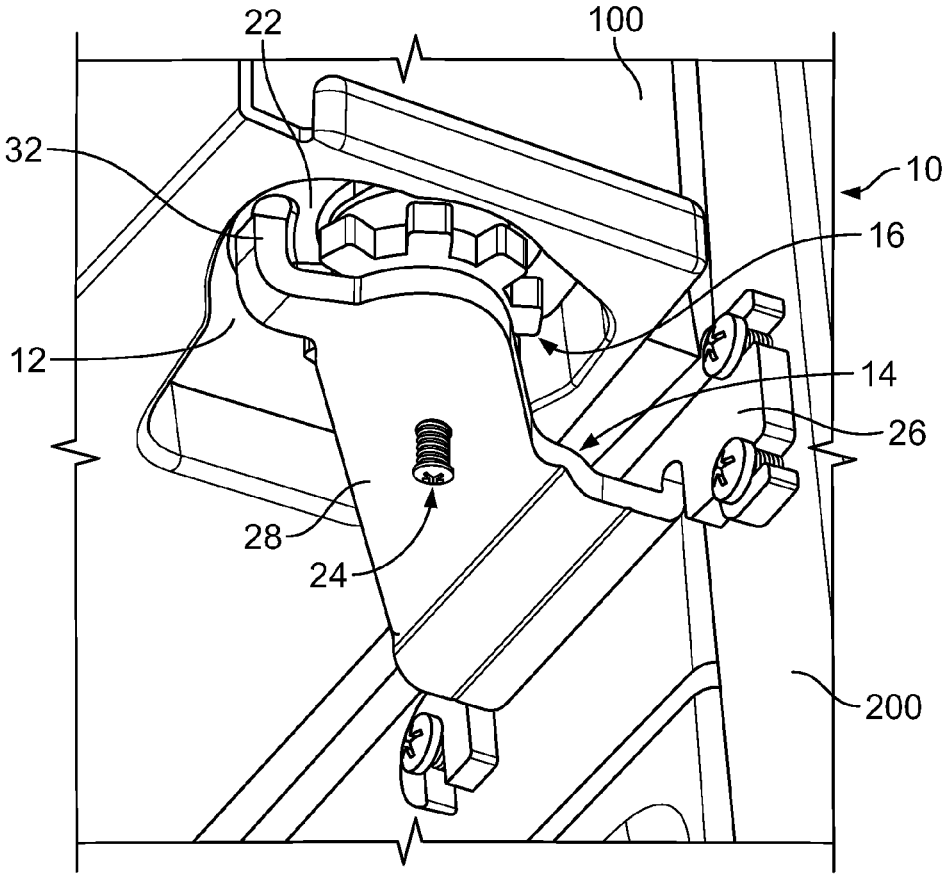
FIG. 1 is a perspective view of one example embodiment of a hinge assembly for a door of an enclosed structure.

Examples of embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

The present invention may be applicable to a variety of enclosed structures having an opening that is closed off by pivoting doors such as refrigerators, freezers, wine cellars, cabinets, closets, cupboards or the like. However, the present invention may also be part of a larger structure, such as a building, for an opening, such as a window. The enclosed structure may have one or more doors that pivot to open or close off a compartment and are hinged by assemblies such as the present invention. In one embodiment, two out-swinging doors (i.e., side-by-side or French style doors) can be provided to reveal the compartments of the enclosed structure, such as in a refrigerator.

Turning to the shown example of FIG. 1, one example hinge assembly 10 for adjusting a height of a door 100 is shown as implemented on an example enclosed structure 200, such as a cabinet. The hinge assembly 10 illustrated in the figures is adapted to be mounted on the right side of an enclosed structure 200 as viewed by a user. Thus, it should be noted that a hinge assembly 10 for a left side of the enclosed structure 200 will substantially mirror the illustrated hinge assembly 10 in shape. A person of ordinary skill in the art will be able to make the accommodations necessary to construct a hinge assembly 10 for the left side based on the description below.

Figure 2:
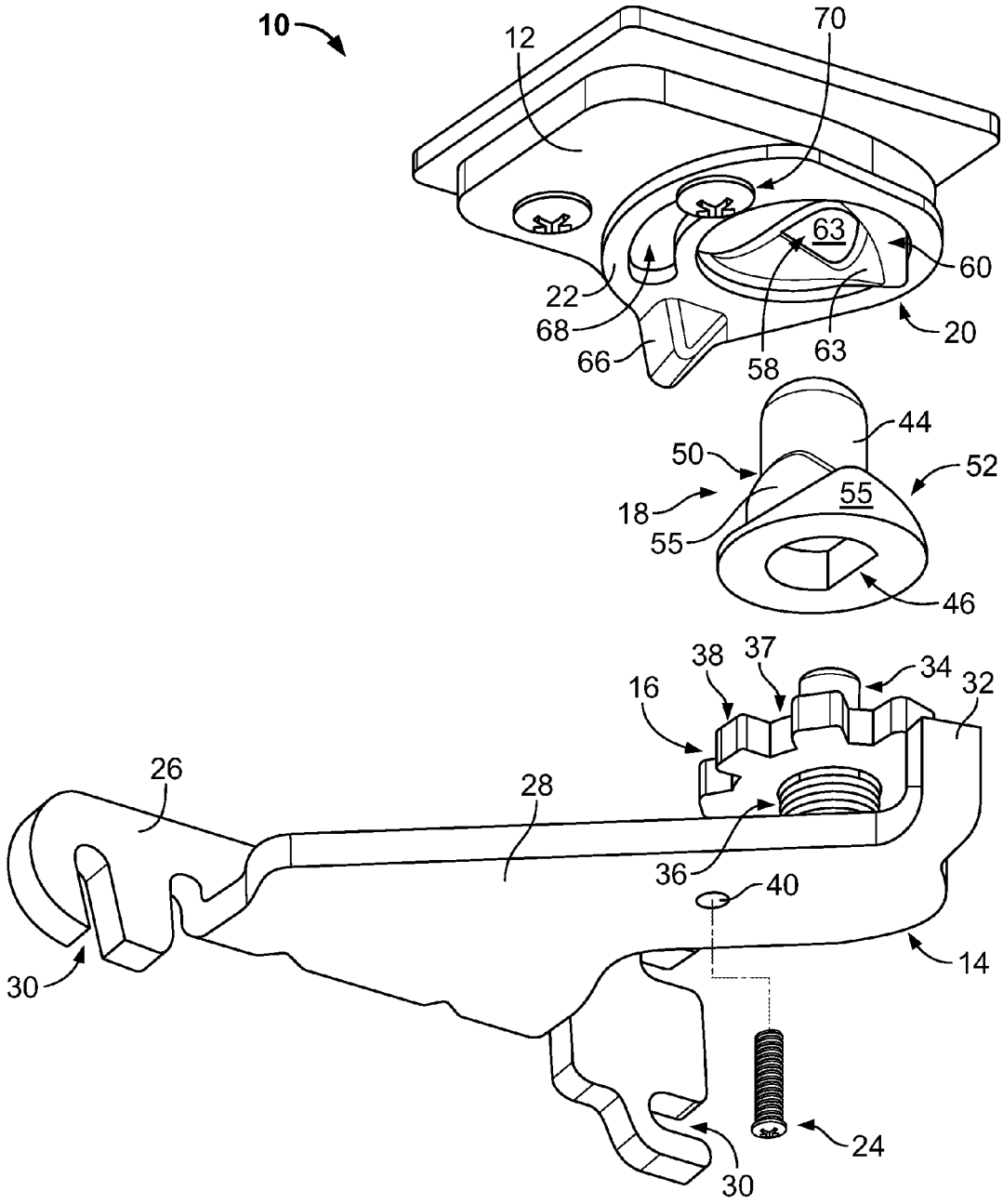
FIG. 2 is an exploded view of the hinge assembly of FIG. 1.
Figure 3:
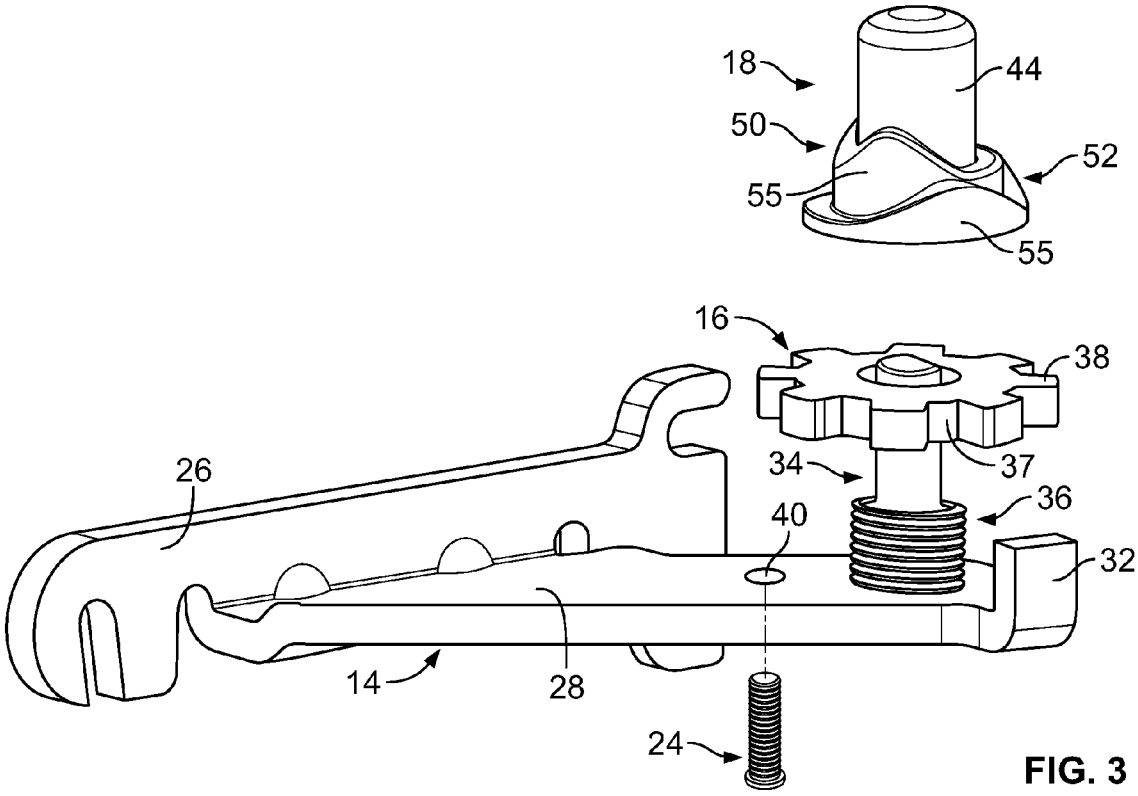
FIG. 3 is an exploded, top perspective view of certain components in the hinge assembly.

As shown in FIGS. 2-3, the example hinge assembly 10 may include various elements, such as any or all of a mounting plate 12, a hinge plate 14, a height adjuster 16, a first cam element 18, a second cam element 20, a limiting plate 22 and a locking element 24.

The hinge plate 14 allows the hinge assembly 10 to be mounted near an opening of the enclosed structure 200 to support a door 100. As shown in FIGS. 2 and 3, one embodiment of the hinge plate 14 may include a mounted portion 26 and a base portion 28. The mounted portion 26 of the hinge plate 14 may be elongate so as to extend across a surface of the enclosed structure 200 in a mounted state and may be oriented upright including a plurality of recesses or holes 30 that allow the hinge plate 14 to be removably or non-removably secured on an exterior of the enclosed structure 200 by way of fastening structure, such as screws. Holes 30 can be elongate for adjustability. However, other means known in the art for securing the hinge plate 14 to the enclosed structure 200, such as gluing, nailing or the like, may also be used.

The base portion 28 provides a base on which other components of the hinge assembly 10 may be mounted. The base portion 28 can also include a stopper 32 for limiting the range of rotation of the door 100 as will be described later. In this embodiment, the base portion 28 is configured to extend laterally toward a side of the enclosed structure 200. Near a proximal end, the base portion 28 provides a pivot 34 that projects from the base portion 28 vertically upward and defines a rotating axis X for the door 100. At least a portion of the pivot 34 can be threaded section 36 that can accommodate the adjuster 16 which can be internally threaded. The adjuster 16 can thus be moved along the threaded section 36 by rotation to adjust the position of the adjuster 16 relative to the threaded section 36 of the pivot 34.

The height adjuster 16 may be a gear-shaped element having a plurality of recesses 37 that can be peripherally provided and can be arranged in various patterns, for example, random, etc., in-between a plurality of peripherally projecting teeth 38. The hinge plate 14 includes a hole 40 that extends through the hinge plate 14 and is positioned about the adjuster 16 such that, as the adjuster 16 is rotated, each of the recesses 37 can become aligned with the hole 40. An elongate locking element 24 can be inserted through the hole 40, which may also be threaded, and project above the base portion 28 to extend at least partially into one of the recesses 37 to inhibit, such as prevent, rotation of the adjuster 16 along the threaded section 36. The diameter of the locking element 24 can be dimensioned to substantially fill each of the recesses 37 so as to reduce the likelihood of the adjuster 16 wiggling and thereby shifting to a position other than a desired position along the threaded section 36 through repeated usage of the door. In one embodiment, the locking element 24 may be a screw or a threaded rod that may be inserted from underneath the hole 40.

The first cam element 18 may be provided to control the movement of the door 100 about the axis of the pivot 34. The first cam element 18 may provide a central, cylindrical portion 44 with rounded edges configured to mate with the second cam element 20 while allowing the second cam element 20 to rotate about the cylindrical portion 44. The first cam element 18 may be configured to be placed on top of the adjuster 16 and may include a bore 46 for accommodating the pivot 34. The bore 46 and the first cam element 18 may be configured to inhibit, such as prevent, rotation of the first cam element 18 about the pivot 34 while allowing sliding movement of the first cam element 18 along the pivot 34. For example, a cross-section of the pivot 34 may be asymmetrically shaped about the rotating axis, and the bore 46 may be shaped correspondingly to accommodate the asymmetrical shape of the pivot 34. For example, the cross section of the pivot 34 may be a rectangle, a semi-circle, a beveled circle or the like. As such, the cross section can automatically orient the first cam element 18 in a predetermined manner about the pivot 34 and the adjustment of the adjuster 16 along the threaded section 36 will result in movement of first cam element 18 along the pivot 34, either upwardly or downwardly depending on the adjustment of the adjuster 16. However, the cross-section of the pivot 34 may also be symmetrically shaped as in a square or a hexagon.

Instead of rendering the pivot 34 with a specific cross-sectional shape, the desired orientation of the first cam element 18 about the pivot 34 may be obtained by providing a hole or slot (not shown), similar to the recesses 37, on a periphery of a base of first cam element 18 to accommodate the locking element 24 and immobilize the first cam element 18 about the pivot 34. It may also be possible to provide a plurality of holes or slots on the base and adjust the orientation of the first cam element 18 in a predetermined fashion about the pivot 34.

Figure 5:
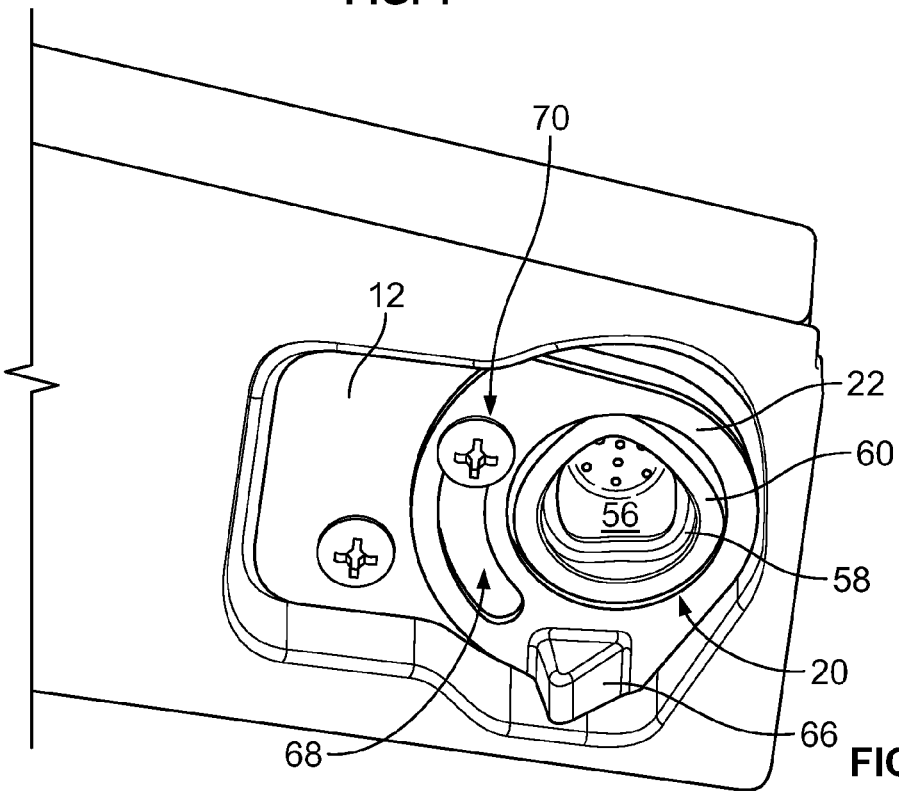
FIG. 5 is a bottom perspective view of certain components in the hinge assembly.
Figure 4:
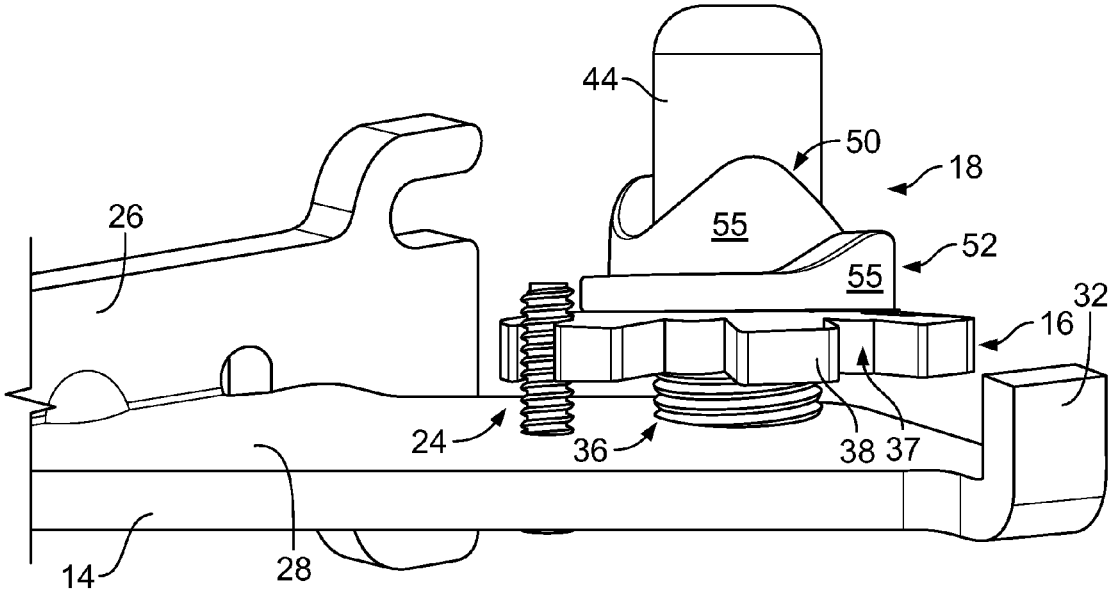
FIG. 4 is an assembled view of certain components in the hinge assembly.

As a result and as shown in FIGS. 4-5, the vertical position of the first cam element 18 along the pivot 34 can be gradually adjusted by removing the locking element 24 from recess 37, and elevating or lowering the adjuster 16 to a desired level, and re-inserting the locking element 24. It is noted that the smallest unit by which the level of the first cam element 18 moves vertically can depend on the number of recesses 37 provided on the periphery of the adjuster 16. For example, a relatively large number of recesses 37 on the adjuster 16 can allow the level of the first cam element 18 to be adjusted more precisely, but may result in adjusters 16 or locking elements 24 that are relatively less rigid.

As shown in FIGS. 2-5, the first cam element 18 may include a plurality of radially discrete, annular cam structures 50, 52, such as a first inner cam 50 and a first outer cam 52, each disposed at least partially around the cylindrical portion 44. In this embodiment, the first inner cam 50 and the first outer cam 52 are radially discrete being located at a first radius and a second radius respectively. The elevations of the first inner cam 50 and the first outer cam 52 vary along the circumference in that each cam 50, 52 includes a first base elevation and a crest elevation. The cams 50, 52 may be at the first base elevation along most of the circumference but may reach the crest elevation at the tip of one or more upward lobes 55, 57. The cams 50, 52 may be offset in elevation such that an elevation range of one cam does not overlap with the elevation range of the other cam. For example, in the embodiment shown in FIG. 3, a first elevation range of the first inner cam 50 is above a second elevation range of the first outer cam 52 and the two ranges do not overlap. Moreover, the angular positions of the upward lobes 55, 57 in the first inner cam 50 may be offset such that no upward lobe 55 in one cam has the same angular position as a different upward lobe 57 in the other cam.

Referring to FIGS. 2 and 5, the first cam element 18 is configured to interact with the second cam element 20. In this embodiment, the second cam element 20 is integrated into the mounting plate 12. The second cam element 20 may be mounted securely about the door 100. The second cam element 20 may be integrally formed on a mounting plate 12 secured to the door 100. The mounting plate 12 may provide a hole 56 into which the cylindrical portion 44 of the first cam element 18 may be inserted. Around the hole 56, the second cam element 20 may be provided with annular cam structures 58, 60 configured to interact with the annular structures of the first cam element 18. For example, the annular cam structures may include a second inner cam 58 and a second outer cam 60. Similarly, in this embodiment, the second inner cam 58 and the second outer cam 60 are radially discrete and are located substantially at the first radius and the second radius respectively so as to interact with the first inner cam 50 and the first outer cam 52, respectively. The elevations of the second inner cam 58 and the second outer cam 60 vary along the circumference in that each cam 58, 60 includes a second base elevation and a trough elevation. In one example, the cams may be at the second base elevation along most of the circumference but may reach the trough elevation at the trough of one of the downward lobes 63, 65. The cams 58, 60 may be offset in elevation such that an elevation range of one cam does not overlap with the elevation range of the other cam. For example, in the embodiment shown in FIGS. 2 and 5, a third elevation range of the second inner cam 58 is above a fourth elevation range of the second outer cam 60 and the two ranges do not overlap. Moreover, the angular positions of the downward lobes 63, 65 in the second inner cam 58 may be offset such that no downward lobe 63 in one cam has the same angular position as a different downward lobe 65 in the other cam.

The interaction between the first inner cam 50 and the first outer cam 52 of the first cam element 18, and the second inner cam 58 and the second outer cam 60 of the second cam element 20, causes the door 100 to be biased to a number of discrete angular positions depending on the angular position of the door 100. The door 100 may be configured to automatically return to a closed position when the angular position of the door 100 is between 0 and 60 degrees relative to a front face of the enclosed structure 200, for example, and/or may be configured to automatically open the door 100 to an angular position of 110 degrees, for example, when the angular position of the door is 60 degrees or greater, for example. The door 100 may be configured to have more than two discrete angular positions to which the door 100 is biased. Also, the angular positions at which the biased direction of the door 100 changes may also vary. This is made possible by the interaction between the upward and downward lobes 55, 57, 63, 65 on the cams 50, 52, 58, 60 in that the upward lobes 55, 57 divide up the circumference into a number of arced zones that the downward lobes 63, 65 may move between. For example, when a tip of the downward lobe 63 crosses over a tip of an upward lobe 55, the weight of the door 100 causes the tip of downward lobe 63 to move down from the crest elevation to the first base elevation biasing the door 100 toward one of the discrete angular positions.

The mounting plate 12 may further be configured to accommodate the limiting plate 22 that can be secured at least partially around the second cam element 20 and the hole 56 of the mounting plate 12. The mounting plate 12 need not be configured to accommodate the limiting plate 22 and it may be possible to mount the limiting plate 22 directly on the door 100. The limiting plate 22 can be substantially ring-shaped and includes a hole 59 for placing the limiting plate 22 around the second cam element 20. The mounting plate 12 can include recesses or holes for securing structures, such as screws, in order to secure the mounting plate to the door. The limiting plate 22 can also include a limiter 66 that is configured to catch the stopper 32 on the base portion 28 of the hinge plate 14 when the door 100 rotates a predetermined amount to inhibit, such as prevent, further rotation of the door 100. The limiter 66 is thus located away from the rotational axis at substantially the same distance as the stopper 32. The range of rotation of the door 100 may be increased or decreased by readjusting the position of the limiter 66 with respect to the mounting plate 12 and controlling the angle the limiter 66 can rotate before contacting the limiter 66. For example, the limiting plate 22 may include a slot 68 through which a screw 70 can pass and secure the limiting plate 22 to the mounting plate 12. The same slot 68 may be curved and allow the limiting plate 22 to be rotated with respect to the mounting plate 12 when the screw 70 is unscrewed. As stated above, the limiting plate 22 may be secured directly on the door 100 rather than the mounting plate 12.

The hinge assembly 10 provides a convenient way of adjusting the height of the door 100. In order to make an adjustment, a user first unscrews the locking element 24 such that the locking element 24 does not hinder rotation of the height adjuster 16. The user then rotates the height adjuster 16 about the pivot 34 and either lowers or raises the height adjuster 16 along the threaded section 36. The rotation of the height adjuster 16 will consequently move the first cam element 18, and the second cam element 20, to alter the height of the door 100. Once the desired height for the door 100 is reached, the user can secure the height adjuster 16 about the pivot by re-inserting the locking element 24 into one of the recesses 37. Moreover, the interaction between the first cam element 18 and the second cam element 20 allows the door 100 to be biased into a number of discrete angular positions depending on the angular position to which the door is rotated such that a user need not manipulate the door 100 throughout the entire rotational movement. Furthermore, the range of the rotational movement of the door 100 can be increased or decreased by adjusting the position of the limiting plate 22.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A hinge assembly for a pivoting door mounted about an opening, including:

a hinge plate mounted about the opening and including a pivot projecting therefrom and a hole extending therethrough, the pivot including a threaded section and defining an axis about which the door can pivot;

an internally threaded adjuster arranged about the threaded section of the pivot and configured to be rotatably adjustable along the threaded section, the adjuster including a plurality of teeth that are peripherally arranged thereabout to define a plurality of recesses that are capable of becoming aligned with the hole through movement of the adjuster, the adjuster being further configured to support the door; and a locking element configured to extend through the hole and at least partially into one of the plurality of recesses to thereby maintain a position of the adjuster along the pivot.

2. The hinge assembly of claim 1, further including a limiting plate mounted on the door and including a limiter, the hinge plate further including a stopper, the limiter positioned to catch the stopper during a rotation of the door such that a rotational range of the door is limited to a predetermined angle.

3. The hinge assembly of claim 2, wherein the limiting plate is capable of being angularly adjusted about the door such that the rotational range of the door is adjustable to a different predetermined angle.

4. The hinge assembly of claim 1, further including a first cam element arranged about the pivot and configured to be movably adjustable along the threaded section through the movement of the adjuster, the first cam element including a first inner cam at a first radius and a first outer cam at a second radius, the first inner cam having a first elevation range and the first outer cam having a second elevation range, the first inner cam and the first outer cam being offset in elevation about one another such that the first elevation range and the second elevation range do not overlap.

5. The hinge assembly of claim 4, the first cam element further including a first upward lobe of the first inner cam and a second upward lobe of the first outer cam, the first upward lobe and the second upward lobe being angularly offset about one another.

6. The hinge assembly of claim 4, the hinge assembly further including a second cam element configured be mounted about the door and interact with the first cam element, the second cam element having a second inner cam at the first radius and a second outer cam at the second radius, the second inner cam having a third elevation range and the second outer cam having a fourth elevation range, the second inner cam and the second outer cam being offset in elevation about one another such that the third elevation range and the fourth elevation range do not overlap.

7. The hinge assembly of claim 6, the second cam element further including a first downward lobe of the second inner cam and a second downward lobe of the second outer cam, the first downward lobe and the second downward lobe being angularly offset about one another.

8. The hinge assembly of claim 1, wherein the locking element is a screw.

9. A hinge assembly for a pivoting door mounted about an opening, including:

a hinge plate mounted about the opening and including a pivot projecting therefrom;

a first cam element placed about the pivot and including a first inner cam at a first radius and a first outer cam at a second radius, the first inner cam having a first elevation range and the first outer cam having a second elevation range, the first inner cam and the first outer cam being offset in elevation about one another such that the first elevation range and the second elevation range do not overlap, further including a first lobe at the first radius and a second lobe at the second radius, the first lobe and the second lobe being angularly offset about one another, the first cam element defining an axis on which a door can pivot; and a second cam element configured to be mounted about the door and to interact with the first cam element, the second cam element having a second inner cam at the first radius and a second outer cam at the second radius, the second inner cam having a third elevation range and the second outer cam having a fourth elevation range, the second inner cam and the second outer cam being offset in elevation about one another such that the third elevation range and the fourth elevation range do not overlap, the second cam element further including a first downward lobe of the second inner cam and a second downward lobe of the second outer cam, the first downward lobe and the second downward lobe being angularly offset about one another.

10. The hinge assembly of claim 9, the hinge plate further including a hole extending therethrough, the pivot including a threaded section, the assembly further including an internally threaded adjuster arranged about the threaded section of the pivot to support the first cam element and configured to be rotatably adjustable along the threaded section thereby moving the first cam element, the adjuster including a plurality of teeth that are peripherally arranged thereabout to define a plurality of recesses that are capable of becoming aligned with the hole, the assembly further including a screw configured to extend through the hole and one of the plurality of recesses thereby maintaining a position of the adjuster along the pivot.

11. The hinge assembly of claim 9, further including a limiting plate mounted on the door and including a limiter, the hinge plate further including a stopper, the limiter positioned to catch the stopper during a rotation of the door such that a rotational range of the door is limited to a predetermined angle.

12. The hinge assembly of claim 11, wherein the limiting plate is capable of being angularly adjusted about the door such that the rotational range of the door is changed from the predetermined angle.

13. A hinge assembly for a pivoting door mounted about an opening, including:

a hinge plate mounted about the opening and including a pivot and a stopper both projecting from the hinge plate, the pivot defining an axis about which the door can pivot;

a first cam element arranged about the pivot;

a second cam element configured to be mounted about the door and to interact with the first cam element; and a limiting plate mounted about the second cam element and including a limiter positioned to catch the stopper during a rotation of the door such that a rotational range of the door is limited to a predetermined angle, wherein the limiting plate is capable of being angularly adjusted about the second cam element such that the rotational range of the door is adjusted to a different predetermined angle.

14. The hinge assembly of claim 13, the hinge plate further including a hole therethrough, the pivot including a threaded section, the assembly further including an internally threaded adjuster configured to move along the threaded section, the adjuster including a plurality of teeth that are peripherally scattered thereabout to define a plurality of recesses that are capable of becoming aligned with the hole, the assembly further including a screw configured to be inserted into the hole and one of the plurality of recesses thereby maintaining a position of the adjuster along the pivot.

15. The hinge assembly of claim 13, the first cam element including a first inner cam at a first radius and a first outer cam at a second radius, the first inner cam having a first elevation range and the first outer cam having a second elevation range, the first inner cam and the first outer cam being offset in elevation about one another such that the first elevation range and the second elevation range do not overlap.

16. The hinge assembly of claim 15, the first cam element further including a first lobe at the first radius and a second lobe at the second radius, the first lobe and the second lobe being angularly offset about one another.

17. The hinge assembly of claim 15, the second cam element having a second inner cam at a first radius and a second outer cam at a second radius, the second inner cam having a third elevation range and the second outer cam having a fourth elevation range, the inner cam and the outer cam being offset in elevation about one another such that the third elevation rang and the fourth elevation range do not overlap.

18. The hinge assembly of claim 17, the second cam element further including a first downward lobe of the second inner cam and a second downward lobe of the second outer cam, the first downward lobe and the second downward lobe being angularly offset about one another.

* * * * *